US009192841B1

(12) United States Patent
Montgomery

(10) Patent No.: US 9,192,841 B1
(45) Date of Patent: Nov. 24, 2015

(54) PORTABLE GOLF GAME PRACTICE DEVICE

(71) Applicant: Neil E. Montgomery, Venetia, PA (US)

(72) Inventor: Neil E. Montgomery, Venetia, PA (US)

( * ) Notice: Subject to any disclaimer, the term of this patent is extended or adjusted under 35 U.S.C. 154(b) by 214 days.

(21) Appl. No.: 13/852,617

(22) Filed: Mar. 28, 2013

Related U.S. Application Data

(60) Provisional application No. 61/616,690, filed on Mar. 28, 2012.

(51) Int. Cl.
*A63B 69/36* (2006.01)
*A63B 63/00* (2006.01)

(52) U.S. Cl.
CPC ..... *A63B 69/3661* (2013.01); *A63B 63/00* (2013.01)

(58) Field of Classification Search
CPC ..... A63B 63/00; A63B 2210/50; A63B 69/3661; A63B 69/36; A63B 67/02; A63B 67/025
USPC ..... 473/170, 172, 173, 195–197; 273/398–402; 5/110, 127, 128, 130
See application file for complete search history.

(56) References Cited

U.S. PATENT DOCUMENTS

| | | | | | |
|---|---|---|---|---|---|
| 448,209 | A | * | 3/1891 | Chorlton et al. | 5/110 |
| 469,554 | A | * | 2/1892 | Favor | 273/401 |
| 1,392,662 | A | * | 10/1921 | Seibold | 273/400 |
| 1,527,988 | A | * | 3/1925 | McMurtrie | 273/400 |
| 1,745,201 | A | * | 1/1930 | Alston | 473/166 |
| 2,631,303 | A | * | 3/1953 | Valentine | 5/111 |
| 2,805,070 | A | * | 9/1957 | Waters | 473/195 |
| 3,231,280 | A | * | 1/1966 | Coliins | 473/195 |
| 3,264,001 | A | * | 8/1966 | Urban | 473/194 |
| 3,719,362 | A | * | 3/1973 | Blanchard | 473/194 |
| 3,758,116 | A | * | 9/1973 | Pieronek | 473/196 |
| 3,822,883 | A | * | 7/1974 | De Vos | 273/400 |
| 4,066,262 | A | * | 1/1978 | Stiefel | 273/400 |
| 4,093,222 | A | | 6/1978 | Eshleman | |
| 4,098,507 | A | | 7/1978 | Hudon | |
| 4,281,834 | A | * | 8/1981 | Chavez | 473/194 |
| 4,336,939 | A | | 6/1982 | Krumlauf | |
| 4,556,219 | A | * | 12/1985 | Tillery | 473/197 |
| 4,596,391 | A | | 6/1986 | Carolan, Jr. | |
| 4,703,931 | A | * | 11/1987 | Steen | 473/435 |
| 4,883,272 | A | * | 11/1989 | Lay | 473/436 |
| 5,067,716 | A | | 11/1991 | Namanny et al. | |
| 5,407,203 | A | | 4/1995 | Jones | |
| 5,492,319 | A | * | 2/1996 | Lee | 473/196 |
| 5,516,108 | A | | 5/1996 | Foster et al. | |
| 5,538,253 | A | | 7/1996 | Foster | |
| D407,575 | S | * | 4/1999 | Meoli, Jr. | D6/392 |
| 6,315,677 | B1 | * | 11/2001 | Sandlin | 473/197 |
| 6,517,444 | B1 | * | 2/2003 | Yoon | 473/197 |

(Continued)

*Primary Examiner* — Mark Graham
(74) *Attorney, Agent, or Firm* — Robert C Montgomery; Montgomery Patent & Design, LLC

(57) ABSTRACT

A portable golf practice game which provides an entertaining and competitive means to practice the game of golf is herein disclosed. The game comprises an inclined surface including an aperture, a chipping mat, and carrying bag. The inclined surface enables golf balls to be struck from a desired distance to provide a practicing for one's aim. The game also comprises an alternate embodiment which further comprises a plurality of divided sections attached to the inclined surface which enables golf balls to be struck from a desired distance to provide an alternate practicing means for one's aim. Each embodiment is envisioned to comprise separate scoring systems when each embodiment is used as a competitive game.

8 Claims, 7 Drawing Sheets

(56) References Cited

U.S. PATENT DOCUMENTS

| | | | | |
|---|---|---|---|---|
| 6,761,644 | B1 * | 7/2004 | Aubert | 473/197 |
| 6,860,825 | B2 * | 3/2005 | Clark | 473/478 |
| 6,905,418 | B2 * | 6/2005 | Rhee | 473/197 |
| 6,939,238 | B2 | 9/2005 | Brayton | |
| 7,313,835 | B1 * | 1/2008 | Hodges | 5/111 |
| 7,318,777 | B1 * | 1/2008 | Sells | 473/168 |
| 7,401,785 | B1 * | 7/2008 | Waite | 273/400 |
| 7,543,821 | B2 * | 6/2009 | Winningham et al. | 273/396 |
| 7,731,198 | B2 * | 6/2010 | Cho | 273/396 |
| 8,282,509 | B1 * | 10/2012 | Michaelson et al. | 473/456 |
| 8,469,365 | B2 * | 6/2013 | Byram et al. | 273/410 |
| 8,662,501 | B1 * | 3/2014 | Perales | 273/400 |
| 2003/0032493 | A1 * | 2/2003 | Lin | 473/197 |
| 2004/0214648 | A1 * | 10/2004 | Simpson | 473/172 |
| 2008/0252018 | A1 * | 10/2008 | Chung | 273/402 |
| 2013/0045815 | A1 * | 2/2013 | Cho | 473/197 |

* cited by examiner

PORTABLE GOLF GAME PRACTICE DEVICE

RELATED APPLICATIONS

The present invention was first described in and claims the benefit of U.S. Provisional Patent Application No. 61/616,690 filed on Mar. 28, 2012, the entire disclosures of which are incorporated herein by reference.

FIELD OF THE INVENTION

The present invention relates to a portable golf game practice device including a detachable frame with a landing mat having a sloping profile and a target aperture, a chipping mat, a plurality of golf balls, and a carrying case for all components.

BACKGROUND OF THE INVENTION

Golf is a sport that requires skill, precision, and discretion. Just as with all other sports, it demands practice even from the most seasoned player. The best form of practice is to supplant oneself in a real-life and real-time scenario so as to capture all of the environmental influences that may have an impact on one's game. A golf course is where golf is played, thus practicing on a golf course affords the best environment to hone the requisite skills for golf. Yet, attending a golf course to practice is not always convenient. Furthermore, although a real-life and real-time scenarios affords the best environment for practice, there are advantages to be exploited from practicing under stylized and controlled environments. Training aids provide such a stylized and controlled environment. A training aid can be tailored to force a practitioner to identify deficiencies and develop competencies. There are many aspects of golf but striking a golf ball is generally segmented into three (3) types of strikes: 1) driving; 2) chipping; and, 3) putting. While all are important, chipping tends to provide golf practitioners with a great deal of difficulty. Thus, chipping is an important skill to improve upon. Many avid golfers would benefit from having the ability to practice chipping in a controlled environment. The development of the present invention fulfills that need.

Prior art in this field consists of training aids that are elaborate systems or even requires attending driving ranges. Putting training aids exist and are quite comprehensive in scope. Yet, existing chipping aids either consist of elaborate systems or of golf club devices. These elaborate systems are costly and tend to require large space in order to be effective. Chipping golf club devices force a user to maintain correct posture and arm positioning. Furthermore, existing chipping training aids are solo aids, thus do not facilitate an engaging atmosphere. There is no golf training aid that adequately enables a user to effectively hone the skill of chipping, while, at the same time, engage others to join in. It is an object of this invention to provide a means to practice the art of chipping without having to attend a golf course. It is a further object of this invention for this means to be cost effective and portable. It is a further object of this invention to provide such a training aid that is exciting and engaging so that multiple users can employ the device simultaneously. It is a further object of this invention to provide a chipping training aid that facilitates reconfiguration of the system into alternative embodiments so that multiple games can be played while still honing the skill of chipping.

SUMMARY OF THE INVENTION

The present invention relates to a portable golf practice game, which provides a means to practice the art of golf without having to visit a golf course. The invention comprises of a system of an interchangeable inclined panel, balls, a chipping mat, retaining walls, rails, a plurality of legs, a plurality of rungs, and a carrying bag. The panel is an elongated flat surface having a flap and an aperture at an upper portion thereof. The upper end of the panel is further provided with a backboard and a retaining wall to serve as a retainer for the ball and to contain the ball to the system. The system is provided with a first and second rail positioned along longitudinal side portions of the system. The first and second rails act as a frame for the system and provide a means to attach legs and rungs. The legs, when attached, provide stability and height, and each bottom surface of each leg is provided with a nonskid surface. The legs also position the system to create an incline on the panel. The chipping mat comprises a detached mat that is positioned at a point away from the panel at the discretion of the user. Balls are placed on the chipping mat and struck with a golf club towards the panel and backboard system. As the balls hits the panel and backboard system, the backboard and retaining wall ensure that the balls are restricted to the panel surface. The carrying bag provides storage and transportation to the system. The system is also equipped with accessories to facilitate alternate embodiments and uses of the system. These accessories include a cover for the panel aperture, removably attachable rungs, and removably attachable indicia.

A user places the panel and backboard system on a level surface and creates an inclined surface with the panel by the use of the legs. The chipping mat is positioned at a desired position away from the panel. Balls are placed on the chipping mat and struck with a golf club, thereby directing the balls towards the panel and backboard system. A user hones chipping skills by attempting to direct the balls into the panel aperture. In an alternative embodiment, rungs are attached to the rails. A user then strikes the balls aiming for the areas between the rungs to hone the skill of chipping. In either embodiment, multiple users can use the device simultaneously.

BRIEF DESCRIPTION OF THE DRAWINGS

The advantages and features of the present invention will become better understood with reference to the following more detailed description and claims taken in conjunction with the accompanying drawings in which like elements are identified with like symbols and in which:

DESCRIPTIVE KEY

Figure 1:
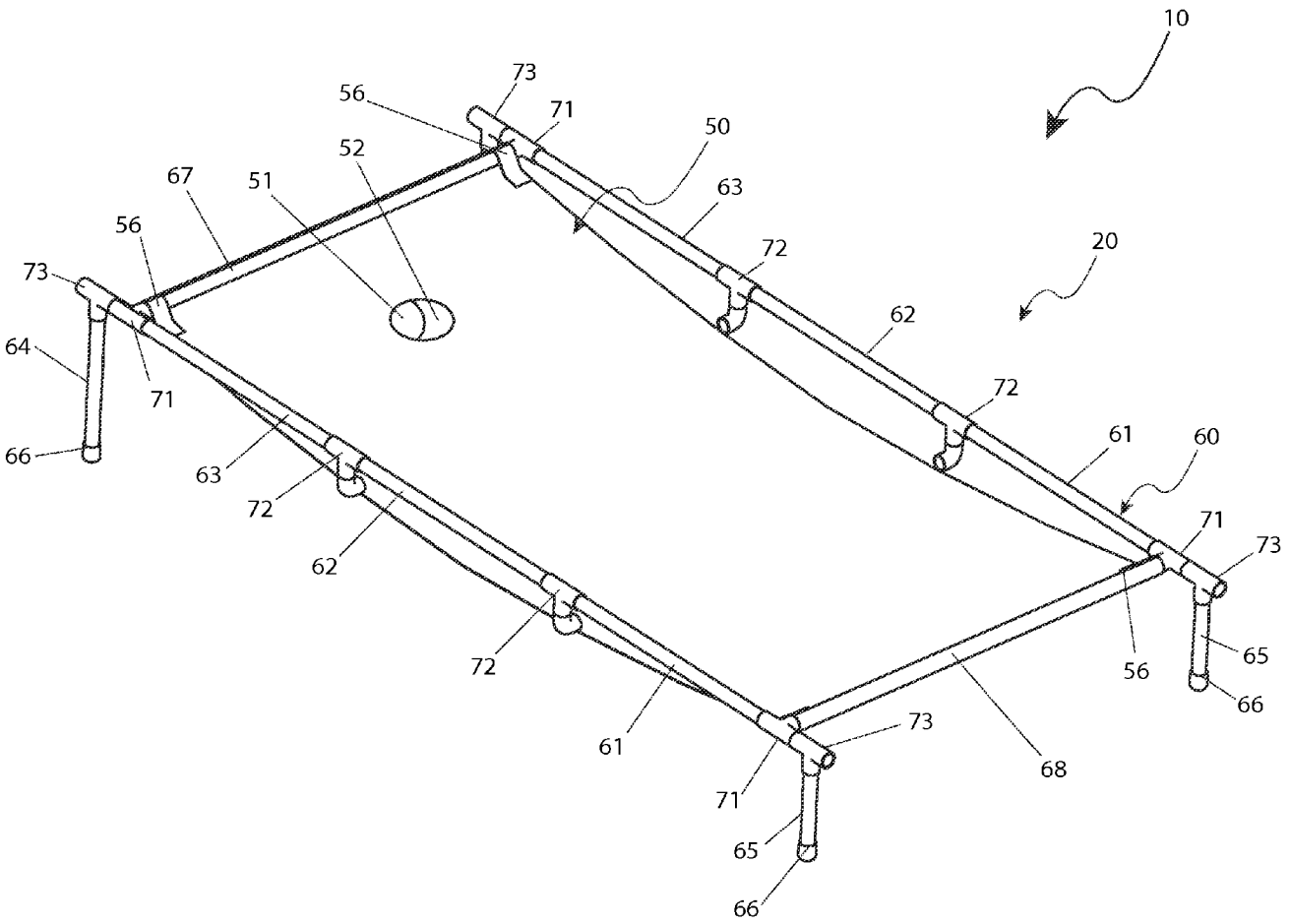
FIG. 1 is a perspective view of a preferred embodiment 20 of a portable golf practice game 10, according to a preferred embodiment of the present invention.

10 portable golf practice game
20 preferred embodiment
30 alternate embodiment
40 second alternate embodiment
50 panel
51 flap
52 opening
54 opening cover
56 panel fastener
60 frame
61 first rail
62 second rail
63 third rail
64 rear leg
65 front leg
66 protective tip
67 upper retaining rung
68 lower retaining rung
71 panel attachment fitting
72 rung attachment fitting
73 leg attachment fitting
75 rung
80 chipping mat
81 surface
82 ball
90 carrying bag
91 elastic closure
92 drawstring
93 bag indicia
110 alternate panel
112 alternate opening
113 alternate flap
115 separator
117 1×2 molding
118 threaded fastener
119 pilot hole
120 alternate frame
121 front
122 side
123 back
124 leg
126 eccentric cam lock fastener
127 fastener stud
130 alternate carrying case
131 carrying case drawstring
132 carrying handle

DETAILED DESCRIPTION OF THE PREFERRED EMBODIMENT

Figure 2:
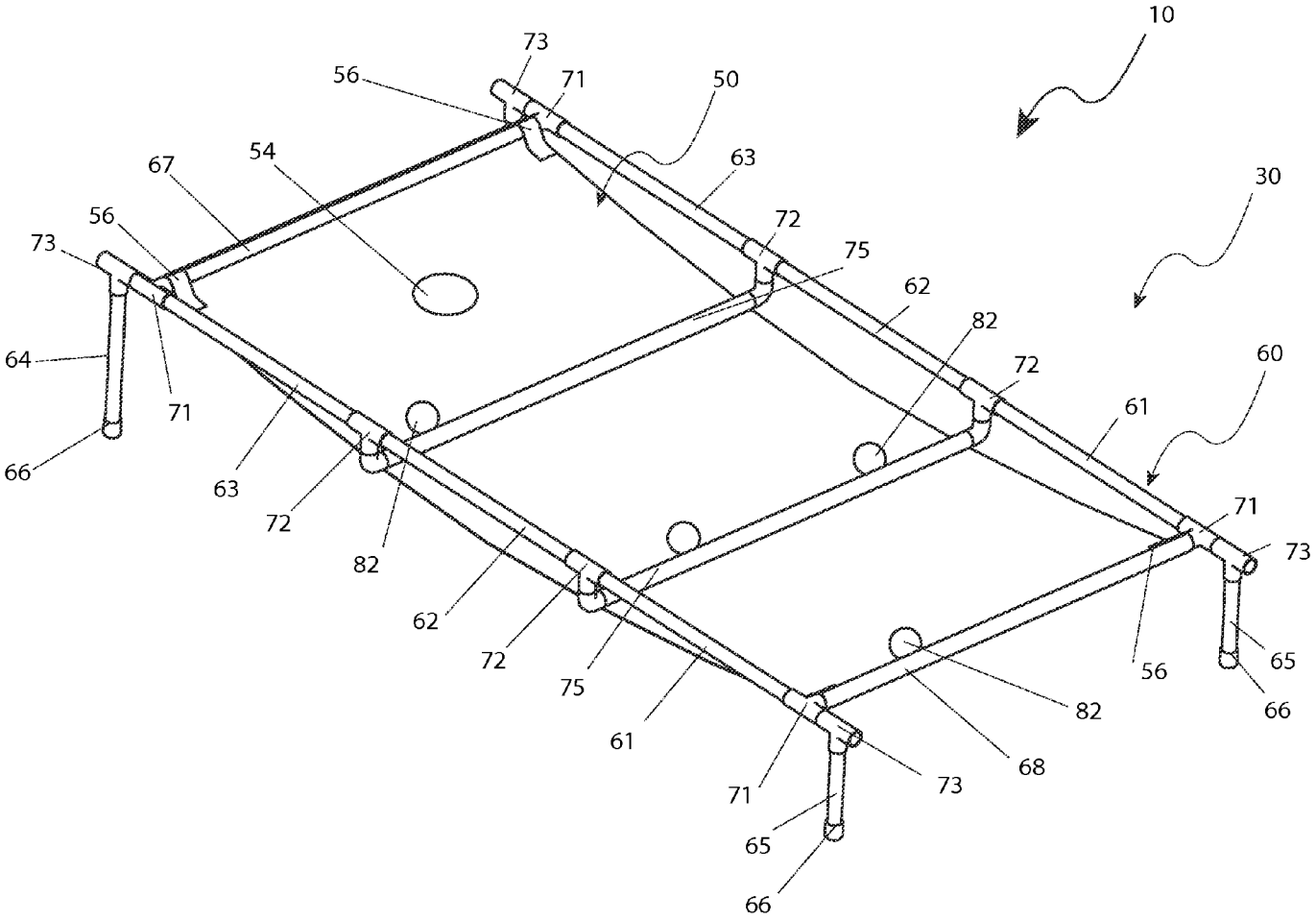
FIG. 2 is a perspective view of an alternate embodiment 30 of the portable golf practice game 10 depicting placement of attachments, according to a preferred embodiment of the present invention.
Figure 3:
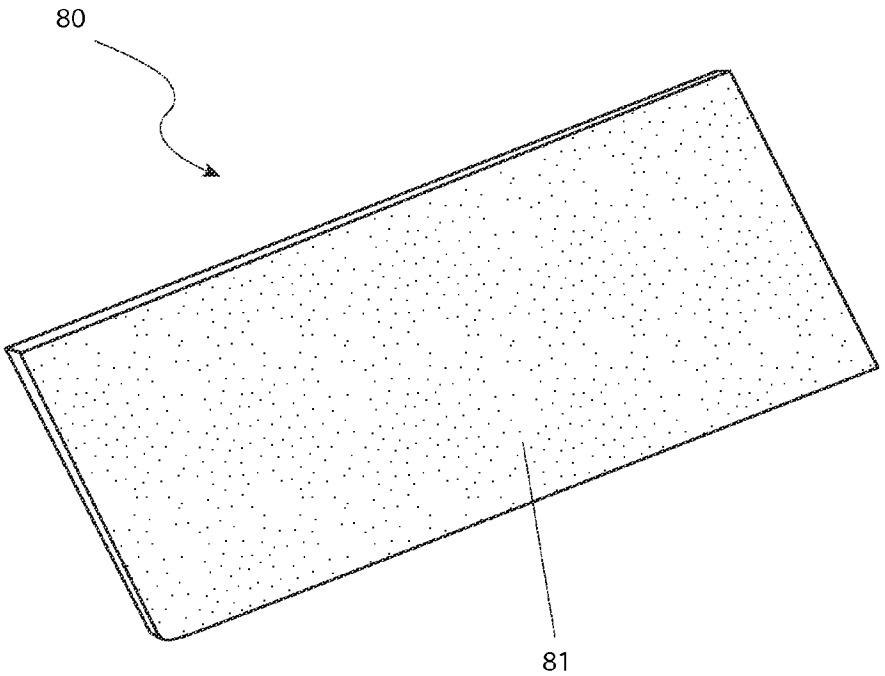
FIG. 3 is perspective view of a chipping mat 81 of the golf practice game 10 according to a preferred embodiment of the present invention.
Figure 4:
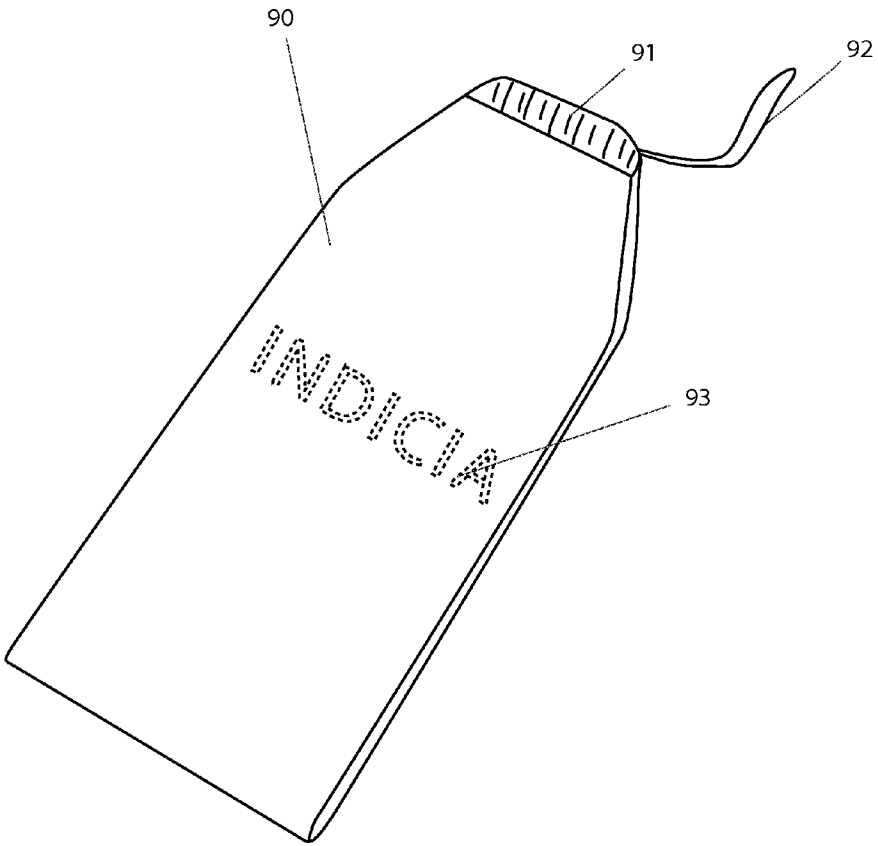
FIG. 4 is a perspective view of a carrying bag 90 of a golf practice game 10 according to a preferred embodiment of the present invention.
Figure 5:
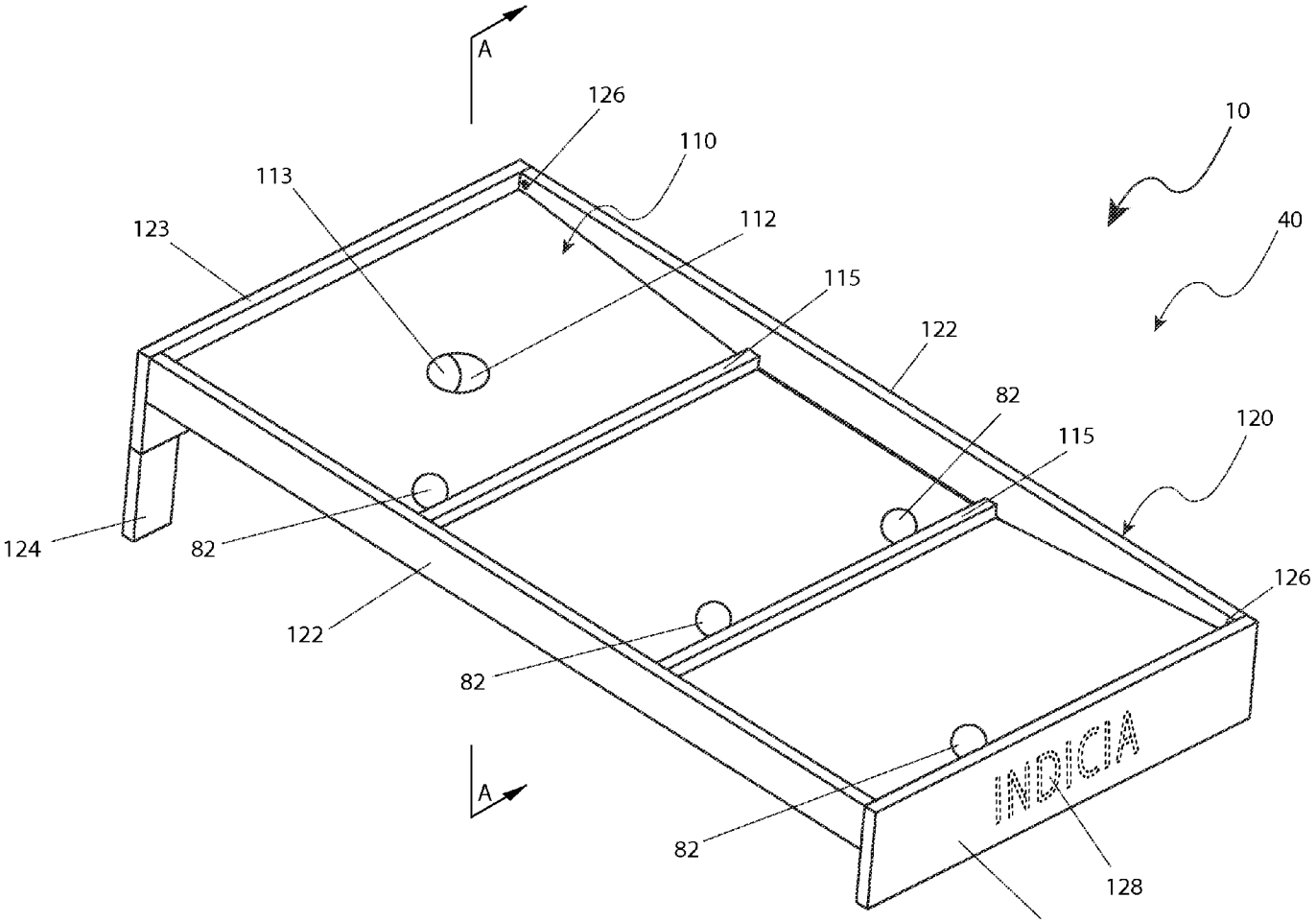
FIG. 5 is a perspective view of a second alternate embodiment 40 of the portable golf practice game 10 depicting an alternate panel 110 attached to an alternate frame 120, according to a preferred embodiment of the present invention.
Figure 6:
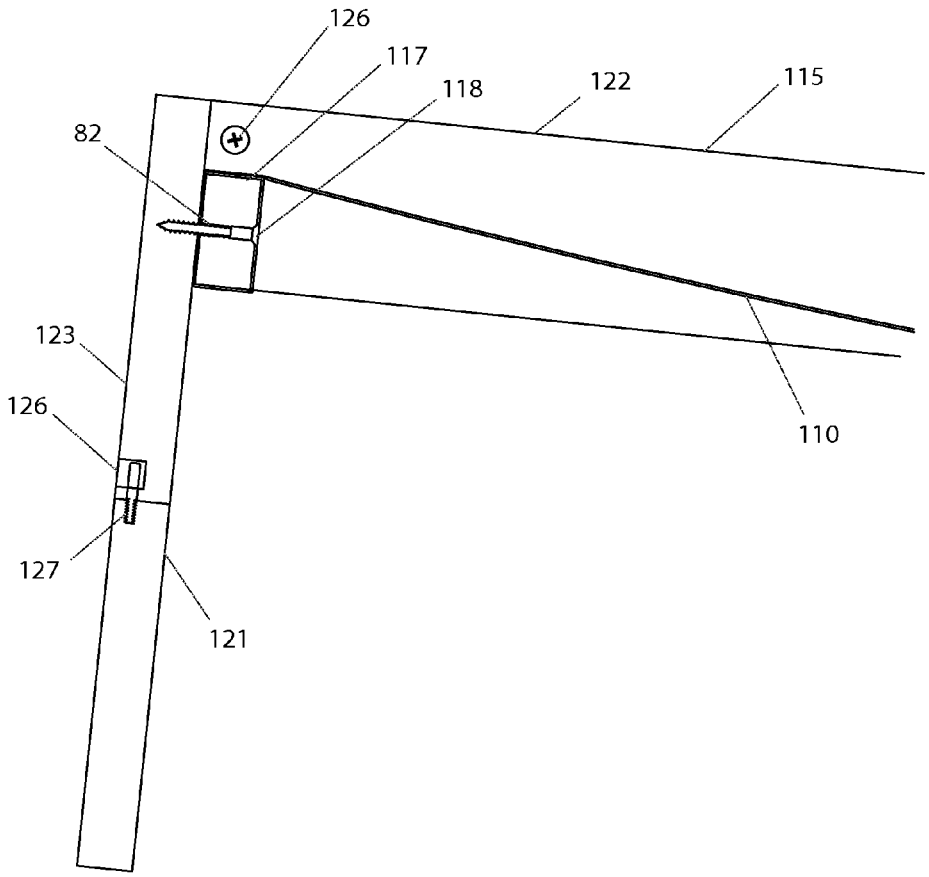
FIG. 6 is a cross section along line A-A as seen in FIG. 5 of the portable golf practice game 10 according to a preferred embodiment of the present invention; and, FIG. 7 is a perspective view of an alternate carrying case 130 for the second alternate embodiment 40 of a portable golf practice game 10 according to a preferred embodiment of the present invention.

The best mode for carrying out the invention is presented in terms of its preferred embodiment, herein depicted within FIGS. 1, 3, and 4, an alternate embodiment 30, herein depicted within FIGS. 2, 3, and 4, and a second alternate embodiment 40, herein depicted in FIGS. 5, 3, and 6. However, the invention is not limited to the described embodiment, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a portable golf practice game (herein described as the "system"), which provides a means for a plurality of golf-related recreational games in two (2) structure. The system comprises a preferred embodiment 20 and an alternate embodiment 30 which comprise an interchangeable inclined panel 50, balls 82, a chipping mat 80, and a carrying bag 90. The system 10 also comprises a second alternate embodiment 40 which utilizes an alternated inclined panel 110 attached to an alternate frame 120, balls 82, a chipping mat 80, and an alternate carrying case 130. The system 10 provides a means for a user, or group of user's, to participate in games similar to a bean bag toss or a ladder toss lawn games, yet utilizing enhanced features pertaining to the game of golf. The system 10 is envisioned to be positioned on a level surface to project a sloped target field which is preferably four (4) feet in length and two (2) feet in width, yet other dimensions may be provided without limiting the scope of said system.

Referring now to FIG. 1, a perspective view of the system 10, according to the preferred embodiment 20 of the present invention, is disclosed. The preferred embodiment 20 comprises a rectangular panel 50 and a tube-and-fitting frame 60. The panel 50 is preferably a felt material, yet other materials may be utilized without limiting the scope of the system. An upper portion of the panel 50 is provided with a flap 51 and an opening 52, thereby providing a hole for a ball 82 to descend into and a backboard, of sorts, to stop said ball 82 from rolling away from the system 10.

The frame 60 is preferably comprised of a plurality of PVC pipe segments interconnected with PVC "T"-fittings. Unless otherwise specified, the manufacturing tolerances of the constituent pipes and fittings will be such that the attachment means between pipes and fittings will be a tight sliding fit. Other materials, or means of attachment, may be used without limiting the scope or function of the system. A first rail 61, a second rail 62, and a third rail 63 are positioned along each of the longitudinal sides of the frame 40 with interconnecting "T"-fittings, thereby providing a means to attach a pair of rear legs 64, a pair of front legs 65, an upper retaining rung 67 and a lower retaining rung 68.

The first ends of the first rails 61 of each side are attached to the cross portion of a panel attachment fitting 71 while the second ends are attached to the cross portion of a rung attachment fitting 72. The rung attachment fittings 72 are preferably comprised of a "T"-fitting which includes an elbow fitting permanently attached to the stem portion of the "T", yet similar fittings may be utilized without limiting the scope of the invention. The first ends of the second rails 62 of each side are attached to the opposite end of the cross portion of the rung attachment fitting 72 at the second end of the first rail 61. The second ends of the second rails 62 of each side are attached to the cross portion of still another rung attachment fitting 72. The first ends of the third rails 63 of each side are attached to the opposite ends of the cross portion of the rung attachment fittings 72 at the second ends of the second rails 62. The second ends of the third rails 63 of each side are attached to the cross portion of still another panel attachment fitting 71.

The lower retaining rung 68 is attached to the stem portion of the panel attachment fitting 71 on the first ends of the first rails 61 of each side with one (1) panel attachment fitting 71 on either end. The lower retaining rung 68 prohibits the ball 82 from rolling off of the system 10 and also enables the panel 50 to be attached to the frame 60. The upper retaining rung 67 is attached to the stem portion of the panel attachment fitting 71 on the second ends of the third rails 63 of each side with one (1) panel attachment fitting 71 on either end. The upper retaining rung 67 is intended to prohibit the ball 82 from rolling off of the system 10 and enables the panel 50 to be attached to the frame 60. A leg attachment fitting 73, with preferably an integral short nipple inserted into one end of the cross portion, is attached to each of the available cross portions of the four (4) panel attachment fittings 71 in such a manner as to have the pipe nipple inserted into the open cross portion of said panel attachment fitting 71 and the post portion oriented all in the same direction, namely down.

The rear legs 64 are preferably comprised of PVC pipe segments, or the same constituent material as the first rail 61. A first end of each of the rear legs 64 is attached to the post portion of each of the leg attachment fittings 73 closest to the second end of the third rail 63. The front legs 65 are preferably comprised of PVC pipe segments, or the same constituent material as the first rail 61. A first end of each of the front legs 65 is attached to the post portion of each of the leg attachment fittings 73 closest to the first end of the first rail 61. The rear legs 64, being of greater length than the front legs 65, give a defined angular orientation to the frame 60 with respect to the normal. Disposed upon the second ends of each of the front legs 65 and the rear legs 64 are protective tips 66 which are comprised of a nonskid rubberized material to increase the stability of the system.

The panel 50 is preferably attached in a slightly loose manner to the retaining rungs 67, 68 with a plurality of hook-and-loop panel fasteners 56.

Referring now to FIG. 2, a perspective view of the system 10, according to an alternate embodiment 30 of the present invention, is disclosed. The system is illustrated herein as depicting an alternate embodiment 30 which enhances the features of the preferred embodiment 20 with additional attachable accessories. The alternate embodiment 30 comprises the panel 50 and the frame 60 as abovementioned in the preferred embodiment 20. The alternate embodiment 30 also comprises a plurality of accessories to enable a user to transform the configuration of the preferred embodiment 20 into another lawn golfing game.

The alternate embodiment 30 comprises an opening cover 54 which shields the abovementioned opening 52, thereby prohibiting a ball 82 from entering said opening 52. The opening cover 54 is fabricated from a material similar to the panel 50 and is secured via a hook-and-loop fastener, yet other securing means may be utilized without limiting the functions of the invention.

The alternate embodiment 30 also comprises two (2) attachable rungs 75 which enable the panel 50 to be separated into three (3) sections. Each rung 75 is preferably fabricated from PVC pipe and each end is attached to the elbow of the rung attachment fittings 72 on each side by means of a tight sliding fit, yet other attachment means may be utilized without limiting the scope of the invention. The sections created by the placement of the rungs 75 can be identified by attachable indicia which are envisioned to correspond to a particular number which represents the rung 75 number or points system. The indicia are preferably attached to the panel 50 via hook-and-loop-type fasteners, yet other means may be utilized without limiting the functions of the system.

The system also comprises a plurality of balls 82, thereby enabling the user to utilize said system in a competing manner. The balls 82 are preferably common golf balls in a variety of colors or patterns which may correspond to competing teams or players.

Referring now to FIG. 3, a perspective view of the chipping mat 80, according to the preferred embodiment of the present invention, is disclosed. The system 10 comprises a detached rectangular chipping mat 81, thereby providing a means to position the balls 82 for striking with a conventional existing golf club. The chipping mat 80 comprises a surface 81 comprised of conventional synthetic carpet or artificial turf, yet other materials may be utilized without limiting the scope of the system. The surface 81 enables the user to position the ball 82 tangentially thereto for common striking or chipping with an existing golf club.

Referring now to FIG. 4, a perspective view of the carrying bag 90, according to the preferred embodiment of the present invention, is disclosed. The carrying bag 90 provides storage and transportation to the system. The carrying bag 90 is preferably fabricated from a durable material such as nylon and comprises dimensions which are proportional to the components of the system 10. A front surface of the carrying bag 90 may include bag indicia 93 which may provide script or logos based upon a user's preference and may include images such as, but not limited to, sports names/logos, personal names, symbols, pictures, and the like to further customize and personalize the system further comprising a variety of colors and patterns. An upper perimeter edge of the carrying bag 790 comprises an elastic closing 91 and a drawstring 92 to provide a closing and sealing to said carrying bag 90.

Referring now to FIG. 5, a perspective view of a second alternate embodiment 40 of the system 10, is disclosed. The second alternate embodiment 40 comprises a rectangular alternate panel 110 and an alternate frame 120 comprised preferably of wooden components which is intended to be easily assembled and disassembled with a user provided Phillips-style screw driver. The alternate frame 120 is comprised of a front 121, two (2) side 122 pieces, a back 123, and two (2) legs 124, preferably fabricated from wood, although laminated wood, or composites of wood by-products may be used, and having a protective coating to inhibit deterioration and add decorative style. The front 121 and the back 123 are attached to the sides 122 with a plurality of eccentric cam lock fasteners 126 and wooden dowel pins (not shown). The cam lock fasteners 126 employ an insert having an eccentric cam lock, preferably located in the sides 122; engage a fastener stud 127 located on the front 121 and on the back 123 pieces. The legs 124 are attached to the lower edge of the back 123 with a plurality of eccentric cam lock fasteners 126 and a fastener stud 127, as seen in FIG. 6, which gives a defined angular orientation to the alternate frame 120 with respect to the normal. Surfaces of any portion of the alternate frame 120 may include game indicia 128 which may provide script or logos based upon the inventor's preference or a user's preference and may include images such as, but not limited to, game instructions, assembly instructions, symbols, pictures, and the like to further customize or personalize the system 10 further comprising a variety of colors and patterns.

The alternate panel 110 is preferably a felt material, yet other materials may be utilized without limiting the scope of the system. A one foot by two foot (1 ft.×2 ft.) molding 117 is attached to each end the alternate panel 110 preferably by gluing a two inch (2 in.) face of the molding 117 to the lower surface of the alternate panel 110 and then wrapping said moldings 117 toward each other for one-and-one-quarter turns (1¼ turns) into said alternate panel 110. Disposed along the medial axis of the molding 117 pieces is a plurality of evenly spaced fastener apertures (not shown) to facilitate the attachment of said molding 117 pieces, now wrapped into the alternate panel 110, to both of the front 121 and the back 123 of the alternate frame 120, in a slightly loose manner, using a plurality of threaded fasteners 118 as seen in FIG. 6. Disposed in the front 121 and in the rear 123 is a plurality of pilot holes 119, evenly spaced to match the fastener apertures in the molding 117, along the medial axis of said front 121 and rear 123 to accept the threaded fasteners 118.

An upper portion of the alternate panel 110 is provided with an alternate flap 113 and an alternate opening 112, thereby providing a hole for a ball 82 to descend into, and a backboard, of sorts, to stop said ball 82 from rolling away from the system 10. A plurality of separators 115 is provided with the system 10 to divide the alternate panel 110 into separate scoring sections. The separators 115 are comprised preferably of wood, with generally a square cross-section and disposed along one face of said separator 115 is a piece, or pieces, of the hook material (not shown) of a hook-and-loop fastener. The purpose of the hook material is to attach the separator 115 to the alternate panel 110 in a temporary manner.

Figure 7:
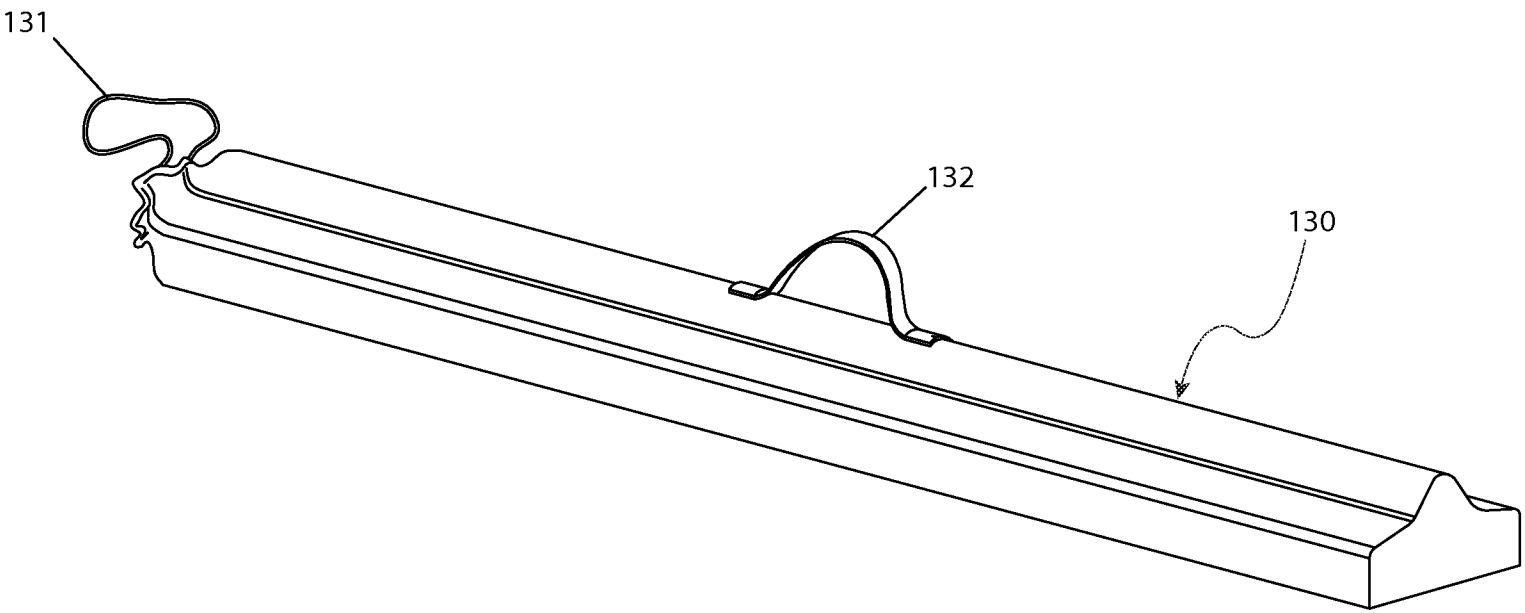

Referring now to FIG. 7, a perspective view of an alternate carrying case 130, according to the second alternate embodiment 40 of the present invention, is disclosed. The carrying case 130 provides storage and transportation to the second alternate embodiment 40. The carrying case 130 is preferably fabricated from a durable material such as nylon and comprises dimensions which are proportional to the specific components of the second alternate embodiment. A carrying handle 132 of a convenient length is disposed along a side of the carrying case 130 to facilitate the ease of transportation of the system 10 while in a disassembled state. The carrying handle 132 may involve a shoulder strap without limiting the scope of the invention. A surface of the carrying case 130 may include other indicia which may provide script or logos based upon a user's preference and may include images such as, but not limited to, sports names/logos, personal names, symbols, pictures, and the like to further customize and personalize the system further comprising a variety of colors and patterns. An upper perimeter edge of the carrying case 130 comprises a drawstring 132 to provide a closing and sealing to the carrying case 130.

After initial purchase or acquisition of the system 10, it would be set up as according to one (1) of the listed embodiments 20, 30, or 40 as indicated in FIG. 1, 2, or 5. The method of utilizing the preferred embodiment 20 of the system 10 may be achieved by performing the following steps: acquiring the system 10; assembling the frame 60 and the panel 50 as shown in FIG. 1; positioning the system 10 on a level surface; positioning the chipping mat 80 at a desired position away from the preferred embodiment 20 and positioning a ball 82 on the surface 81; striking the ball 82 with an existing golf club and aiming for the opening 52; utilizing the system 10 in a competitive gaming means played with teams or individuals as desired; and, enjoying such amusement as the system 10 provides.

The method of utilizing the alternate embodiment 30 of the system 10 may be achieved by performing the following steps: acquiring the system 10; assembling the frame 60, utilizing the rungs 75, and the panel 50 as shown in FIG. 2; positioning the system 10 on a level surface; positioning the chipping mat 80 at a desired position away from the alternate embodiment 30 and positioning a ball 82 on the surface 81; striking the ball 82 with an existing golf club and aiming for the areas between the rungs 75; utilizing the system in a competitive gaming means played with teams or individuals as desired; and, enjoying the amusement the system provides.

The method of utilizing the second alternate embodiment 40 of the system 10 may be achieved by performing the following steps: acquiring the system 10; removing the various components from the carrying case 130; assembling the alternate frame 120, utilizing the eccentric cam lock fasteners 126; installing the alternate panel 110 as shown in FIG. 5; positioning the system 10 on a level surface; positioning the chipping mat 80 at a desired position away from the second alternate embodiment 40 and positioning a ball 82 on the surface 81; striking the ball 82 with a user provided golf club and aiming for the alternate opening 112 but accepting an alternate score for those balls 82 which land in other scoring sections of the alternate panel 110; utilizing the system in a competitive gaming means played with teams or individuals as desired; and, enjoying the amusement the system provides.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A portable golf practice apparatus, comprising:

a modular frame, comprising:

a pair of parallel side members;

a pair of rear vertical members each affixed to a rear portion of each of said pair of parallel side members;

a pair of front vertical members each affixed to a front portion of each of said pair of parallel side members;

a front horizontal member attachable to and spanning a distance between a front location of each of said pair of parallel side members;

a rear horizontal member attachable to and spanning a distance between a rear location of each of said pair of parallel side members;

a plurality of intermediate horizontal members; and, a plurality of pairs of connecting posts located on said pair of parallel side members between said front horizontal member and said rear horizontal member; and, a landing mat having a rear end attached to said rear horizontal member and a front end attached to said front horizontal member, having a partial aperture formed by a circular flap located on said landing mat;

wherein said pair of parallel side members slope downward from said rear horizontal member to said front horizontal member;

wherein each pair of said plurality of pairs of connecting posts are in horizontal alignment;

wherein each intermediate horizontal member is removably attached to one pair of said plurality of pairs of connecting posts; and, wherein said landing mat is loosely attached to said frame.

2. The apparatus of claim 1, wherein said pair of parallel side members each further comprises a plurality of tubular shaft members interconnected to each other via an individual one of said plurality of pairs of connecting posts, said front and rear horizontal members each comprising a tubular shaft member interconnected to said pair of parallel side members, said pair of rear vertical members each comprising a tubular shaft member interconnected to one of said pair of parallel side members and said rear horizontal member, and said pair of front vertical members each comprising a tubular shaft member interconnected to one of said pair of parallel side members and said front horizontal member.

3. The apparatus of claim 1, further comprising a cover removably attached to said landing mat to fully cover said partial aperture.

4. The apparatus of claim 1, further comprising a protective tip removably attachable to each bottom end of said pair of front vertical member and said pair of rear vertical members.

5. The apparatus of claim 2, wherein each of said connecting posts comprises:

a tee fitting interconnecting adjacent ones of said plurality of tubular shaft members in a linear arrangement; and, an elbow fitting attached to and depending downward from said tee fitting, having a connecting end oriented perpendicular to a corresponding one of said pair of parallel side members;

wherein an end of an individual one of said plurality of intermediate horizontal members is attached to said connecting end.

6. The apparatus of claim 1, further comprising a chipping mat.

7. The apparatus of claim 1, further comprising a carrying case.

8. The apparatus of claim 1, further comprising a plurality of golf balls.

* * * * *